US008615837B2

(12) United States Patent
Hale et al.

(10) Patent No.: US 8,615,837 B2
(45) Date of Patent: Dec. 31, 2013

(54) MOTORIZED DRAIN CLEANING MACHINE WITH SPEED CONTROLLER

(75) Inventors: C. David Hale, Wilmington, OH (US); Alfred P. Horning, Dayton, OH (US)

(73) Assignee: Electric Eel Manufacturing Company, Inc., Springfield, OH (US)

( * ) Notice: Subject to any disclaimer, the term of this patent is extended or adjusted under 35 U.S.C. 154(b) by 719 days.

(21) Appl. No.: 12/392,604

(22) Filed: Feb. 25, 2009

(65) Prior Publication Data

US 2009/0211044 A1 Aug. 27, 2009

Related U.S. Application Data

(60) Provisional application No. 61/067,292, filed on Feb. 27, 2008.

(51) Int. Cl.
*B08B 9/02* (2006.01)

(52) U.S. Cl.
USPC ..... 15/104.33; 134/58 R; 318/245

(58) Field of Classification Search
CPC ..... E03F 9/00
USPC ..... 15/104.33, 104.31, 104.095, 104.02, 15/104.03, 104.05, 104.09, 104.16; 254/134.3 FT; 318/245; 134/58 R
See application file for complete search history.

(56) References Cited

U.S. PATENT DOCUMENTS 2,167,268 A * 7/1939 Sanger ..... 15/104.33
2,223,005 A * 11/1940 Kerber ..... 15/104.33
2,297,755 A * 10/1942 Faust ..... 15/104.33
2,467,849 A * 4/1949 O'Brien et al. ..... 15/104.33
2,730,740 A * 1/1956 O'Brien ..... 15/104.33
RE24,308 E * 4/1957 Colegrove ..... 388/837
2,814,012 A * 11/1957 Swanson ..... 388/822
2,873,417 A * 2/1959 Wilkins ..... 388/822
3,159,861 A * 12/1964 Sarcone ..... 15/104.33
3,319,591 A * 5/1967 Hamlett ..... 112/220

(Continued)

FOREIGN PATENT DOCUMENTS

RU 2145528 2/2000

OTHER PUBLICATIONS

Baldor DC Motor. http://www.baldor.com/products. Retrieved Jan. 23, 2012 from Waybackwhen Machine accessed Mar. 12, 2006.*

(Continued)

*Primary Examiner* — Lee D Wilson
*Assistant Examiner* — Tyrone V Hall, Jr.
(74) *Attorney, Agent, or Firm* — Frost Brown Todd LLC

(57) ABSTRACT

A drain-cleaning machine comprises a cable, a motor assembly, and a speed control assembly. The cable comprises a longitudinal axis. The motor assembly is configured to rotate the cable about the longitudinal axis of the cable. The motor assembly comprises a motor and a motor control device. The motor is configured to operate at an operating speed that may vary within a range of operating speeds. The motor is configured to produce a substantially constant torque while operating at varying operating speeds across the entire range of operating speeds. The motor is configured to be powered by DC power. The motor control device is configured to receive AC power from an AC power source, convert the AC power into DC power, and communicate the DC power to the motor. The speed control assembly is configured to vary the operating speed of the motor within the range of operating speeds.

19 Claims, 12 Drawing Sheets

(56) References Cited

U.S. PATENT DOCUMENTS

| | | | | | |
|---|---|---|---|---|---|
| 3,617,859 | A | * | 11/1971 | Dobkin et al. | 323/313 |
| 3,727,261 | A | * | 4/1973 | Levine | 15/104.33 |
| 4,280,581 | A | * | 7/1981 | Rudwick | 180/206.5 |
| 4,763,374 | A | * | 8/1988 | Kaye | 15/104.33 |
| 4,944,464 | A | * | 7/1990 | Zelenka | 242/564.4 |
| 5,199,129 | A | * | 4/1993 | Salecker et al. | 15/104.33 |
| 5,251,356 | A | * | 10/1993 | Oaki et al. | 15/104.095 |
| 5,528,485 | A | * | 6/1996 | Devilbiss et al. | 363/89 |
| 5,875,508 | A | | 3/1999 | Hale | |
| 6,009,588 | A | * | 1/2000 | Rutkowski | 15/104.33 |
| 6,637,064 | B2 | * | 10/2003 | Silverman et al. | 15/104.33 |
| 7,676,879 | B1 | * | 3/2010 | Rutenberg et al. | 15/104.33 |
| 2008/0098544 | A1 | * | 5/2008 | Rutkowski et al. | 15/104.33 |

OTHER PUBLICATIONS

"K-40 Drain Cleaner," Operator's Manual, Rigid Tool Company, pp. i-14.

"New Cordless Battery Operated Drain Sewer Demo Machine," Trojan Tool Manufacturing, http://egi.ebay.com/NEW-CORDLESS-BATTERY-OPERATED-DRAIN-SEWER . . . , printed Dec. 19, 2007, pp. 1-6.

International Preliminary Report on Patentability and Written Opinion dated Aug. 31, 2010 for Application No. PCT/US2009/035204.

International Search Report dated Jun. 15, 2009 for Application No. PCT/US2009/035204.

Written Opinion dated Jun. 15, 2009 for Application No. PCT/US2009/035204.

Dart Controls Catalog, p. 13 and contact page, 2004.

NKK Switches Catalog, Series S product page and p. 2-06.

Australian Office Action dated Nov. 29, 2012 for Application No. AU 2009229141.

European Communication dated Mar. 28, 2011 for Application No. EP 09725010.4.

European Communication dated Sep. 22, 2011 for Application No. EP 09725010.4.

Russian Communication dated Jan. 9, 2013 for Application No. RU 2010139452.

* cited by examiner

GRAPH A

GRAPH B

MOTORIZED DRAIN CLEANING MACHINE WITH SPEED CONTROLLER

PRIORITY

This application claims priority from the disclosure of U.S. Provisional Patent Application Ser. No. 61/067,292, filed Feb. 27, 2008, entitled "Drain Cleaning Apparatus," the disclosure of which is incorporated by reference herein in its entirety.

BACKGROUND

Motorized drain cleaners incorporating a rotating cable, commonly referred to as a snake, have been used for many years. Some types of drain cleaners use a Permanent Split Capacitor (PSC) AC electric motor for motive power. However, the output torque for a PSC/AC motor may fall off rapidly as the motor speed decreases under load, as illustrated in Graph A. Further the PSC/AC motor may overheat under light loads, thereby requiring an external cooling fan to keep it cool. This inherent characteristic of the PSC/AC motor may make the PSC/AC motor undesirable for use on rotary drain cleaners. As the rotary cable, or snake, meets a stubborn obstacle the rotating cable may slow down thereby resulting in an undesirable torque decrease and the possibility of motor overheating. Due to an inadequate level of performance, the PSC/AC motor may not be suitable for operation at variable speeds or applications requiring the motor to produce rotation at variable speeds.

One alternate type of motorized, rotating cable drain cleaner described in U.S. Pat. No. 4,763,374 issued to Kaye, Aug. 16, 1988, disclosed a motorized drain cleaner that included a permanent magnet motor. In a preferred embodiment, the cleaner incorporated a 12-volt DC motor. However, Kaye only disclosed a cleaner comprising a trigger switch to toggle the motor between on and off settings. The device described in Kaye fails to provide a user the ability to vary the operating speed of the motor during operation, which may hinder the user's ability to effectively and safely remove obstructions from a sewer or drain. While numerous motorized drain cleaners have been made and used for removing obstacles in drains and sewers, it is believed that no one prior to the inventors has made or used the invention described in the appended claims.

BRIEF DESCRIPTION OF THE DRAWINGS

While the specification concludes with claims that particularly point out and distinctly claim the invention, it is believed the present invention will be better understood from the following description taken in conjunction with the accompanying drawings, in which like reference numerals identify the same elements. The drawings and detailed description which follow are intended to be merely illustrative and are not intended to limit the scope of the invention as set forth in the appended claims.

DETAILED DESCRIPTION

Figure 1:
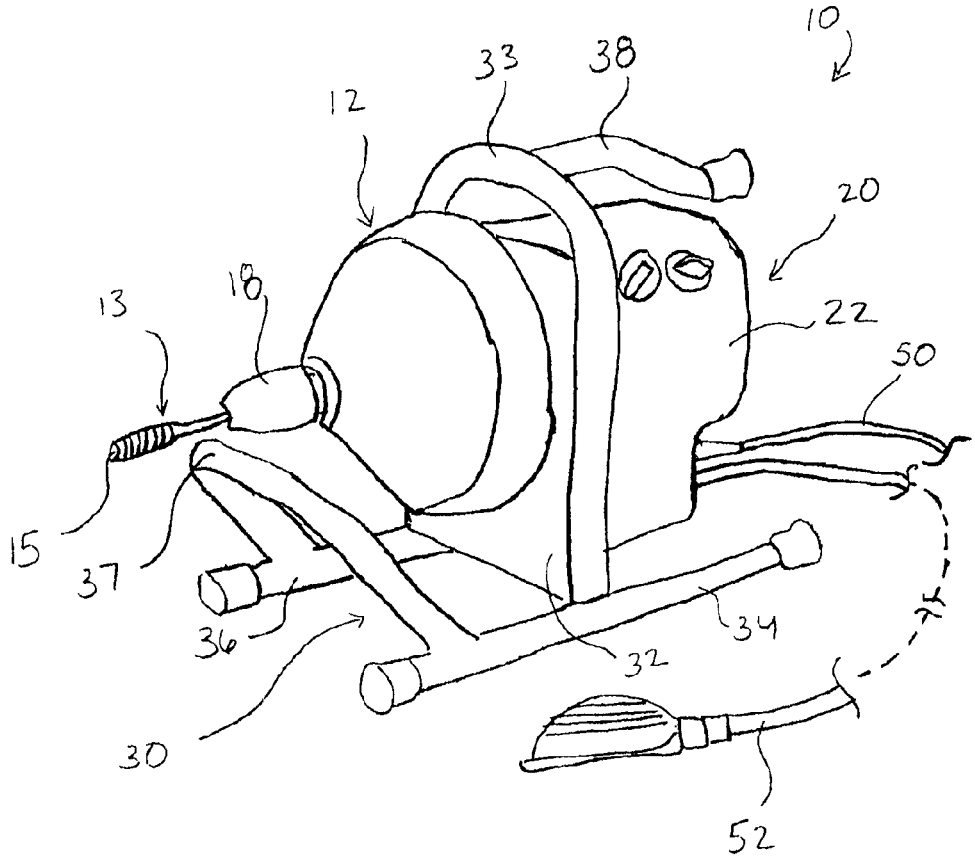
FIG. 1 depicts a perspective view of an embodiment of a motorized drain-cleaning machine.

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that for convenience and clarity, spatial terms such as "vertical" and "horizontal" are used herein with respect to the drawings. However, drain cleaning machines may be used in various orientations and positions, and these terms are not intended to be limiting and absolute.

FIGS. 1-9 depict an exemplary motorized drain-cleaning machine 10 and embodiments of various components thereof. In the illustrated embodiment, machine 10 comprises a cable containing enclosure, or drum 12, a cable 13, an operating assembly 20, and a frame assembly 30. As shown, machine 10 further comprises a power cord 50 and an optional pneumatic foot controlled on-off switch 52. Of course, any suitable on-off switch may be used. Machine 10 is configured to allow a user to insert cable 13, commonly referred to as a snake, into a drain or sewer while cable 13 is rotating in order to remove blockages clogging the drain. In the illustrated version, cable 13 is configured to rotate about its longitudinal axis in response to a rotational force provided by a motor assembly 40, which will be discussed in more detail below. Excess portions of cable 13 may be stored in drum 12, such that a suitable length of cable 13 can be withdrawn from drum 12 during use and fed back into drum 12 for storage. Cable 13 may be withdrawn from drum 12 and inserted into a drain manually by a user. Similarly, cable 13 may also be retrieved from a drain and fed back into drum 12 manually. Alternatively, an automatic feed mechanism, such as the one shown in FIG. 10 and described below, may be used to automatically withdraw cable 13 from drum 12 and re-insert cable 13 into drum 12. As shown, cable 13 comprises an operating end 15 that extends outwardly through an opening 16 in a conical portion of drum 12. As shown, cable 13 also passes through a rotatable chuck 18, which may be configured to grasp a portion of cable 13 in order to facilitate rotation of cable 13. Chuck 18 may comprise a keyless type chuck or any other suitable device. Operating end 15 may be enlarged to facilitate removal of obstructions during use. Cable 13 may comprise any suitable diameter and may be configured to allow a user to attach accessories or tools to operating end 15 in order to further facilitate removal of obstructions.

In the illustrated version, drum 12 is rotatably mounted to a drive shaft 41 and positioned adjacent to the front surface of a frame mounting plate 32. Frame mounting plate 32 is welded to a vertical loop member 33 of frame assembly 30. Of course, frame mounting plate 32 may be attached to frame assembly 30 using any suitable method or device. As mentioned above, drum 12 may be configured to house at least a portion of cable 13. Drum 12 may comprise stainless steel or any other suitable material. In the illustrated example, drum 12 comprises a cylindrical body having a conical portion attached thereto. Of course, it will be appreciated that drum 12 may comprise an enclosure in any suitable shape or size. In this version, drive shaft 41 extends outward from the rear portion of drum 12 and through an opening in frame mounting plate 32. Drive shaft 41 is associated with motor assembly 40 and configured to transfer the rotational force generated by motor assembly 40 to drum 12 and cable 13, thereby causing both drum 12 and cable 13 to rotate.

As shown in FIGS. 1-2 and 4-7, frame assembly 30 comprises vertical loop member 33, a pair of lower support members 34, 36, an angled loop member 37, and an upper support member 38. In this example, vertical loop member 33 and angled loop member 37 extend between lower support members 34, 36, while upper support member 38 extends outwardly from vertical loop member 33. Components of frame assembly 30 may be integral with one another, or, alternatively, the components may be attached to each other using any suitable device or method, including but not limited to fasteners and welding. Lower support members 34, 36 each comprise a foot pad 35*a*, 35*b*, 35*c*, 35*d* attached to each end of a respective lower support member 34, 36. Similarly, upper support member 38 comprises a foot pad 35*e* attached to the free end of upper support member 38. Foot pads 35*a*, 35*b*, 35*c*, 35*d*, 35*e* may comprise rubber or any other suitable material, and foot pads 35*a*, 35*b*, 35*c*, 35*d*, 35*e* may be configured to dampen machine vibrations and reduce vibrational movement of the machine during operation. Lower support members 34, 36 may be configured for positioning and stabilizing machine 10 upon a supporting surface in a horizontal operating position as generally illustrated in FIGS. 1-2 and 3-7. However, machine 10 may also be operated in an upright, vertical position, by setting machine 10 upright such that it rests on each of the two lower support members 34, 36 and upper support member 38.

Figure 6:
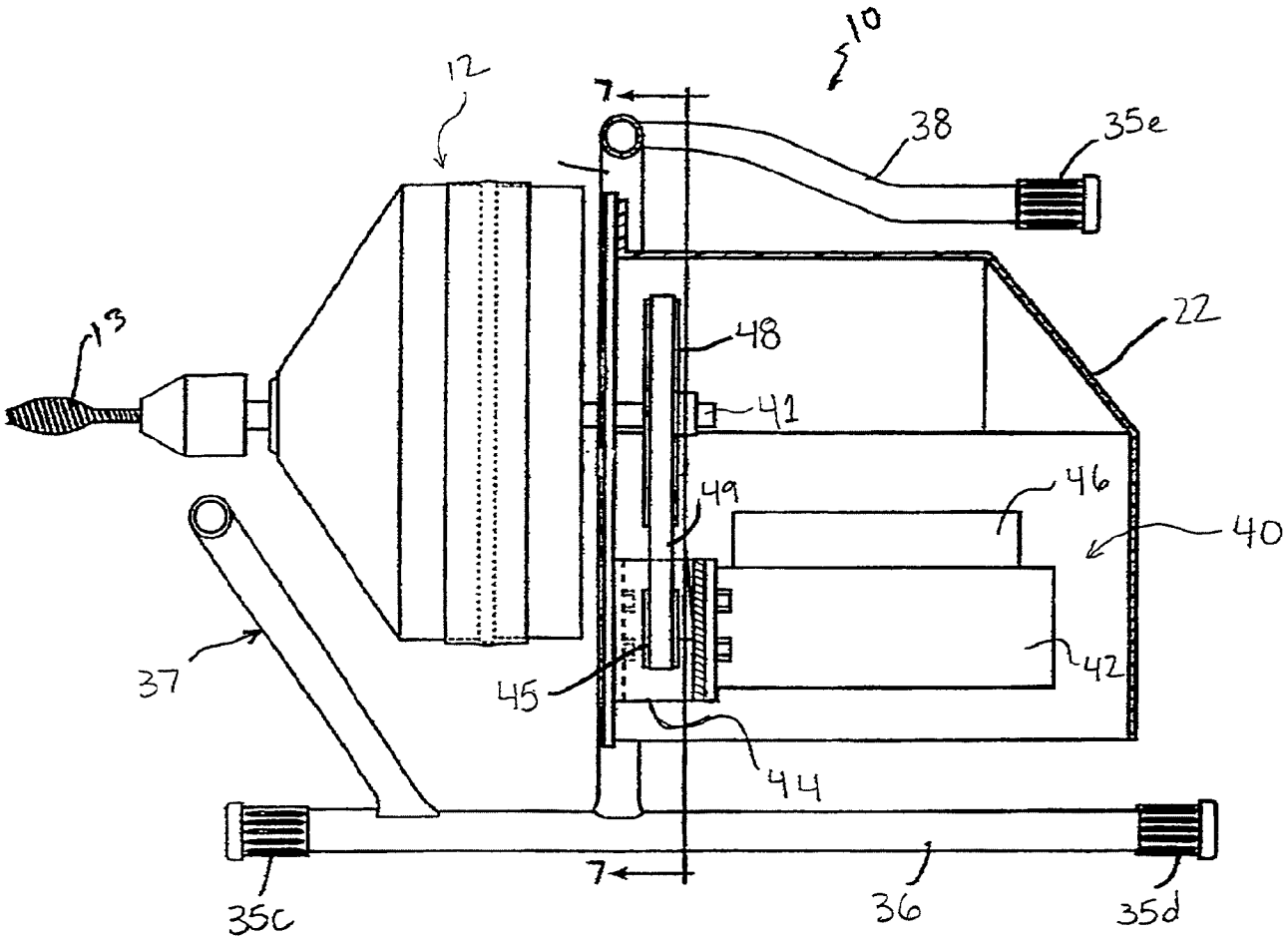
FIG. 6 depicts a side view of the drain-cleaning machine illustrated in FIG. 1, similar to FIG. 4, with a portion of the housing and frame assembly removed.
Figure 7:
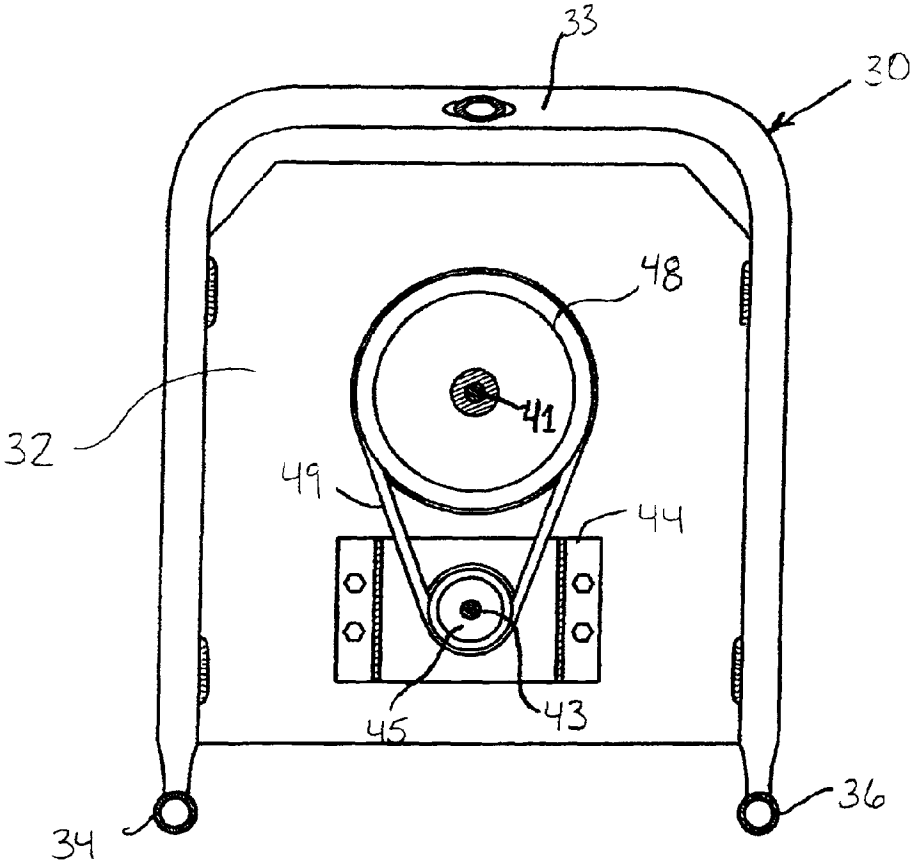
FIG. 7 depicts a lateral cross-sectional view of the drain cleaning machine illustrated in FIG. 1 taken along line 7-7 in FIG. 6.

In the illustrated version, operating assembly 20 comprises a housing 22 configured to house and protect motor assembly 40 and its associated wiring and components. Housing 22 may comprise plastic, metal, or any other suitable material. As shown, housing 22 is attached to a rear surface of frame mounting plate 32. FIGS. 6-7 depict views of machine 10 with at least a portion of housing 22 and frame assembly 30 removed to reveal the internal components of operating assembly 20. In this example, in addition to housing 22, operating assembly 20 further comprises a motor assembly 40, a speed control assembly 70, and a directional switch assembly 80.

In the illustrated embodiment, motor assembly 40 comprises a motor 42, a motor mounting bracket 44, a motor control device 46, a motor control device mounting plate 47, a drive pulley 48, and a drive belt 49. Motor 42 further comprises a motor output shaft 43 and a motor drive pulley 45 mounted thereon. Motor output shaft 43 and motor drive pulley 45 may be configured to uniformly rotate, thereby communicating the rotational force generated by motor 42 to drive shaft 41, drum 12, and, ultimately, cable 13. As a result, the rotational speed of cable 13 may correspond to the operating speed of motor 42. The rotational speed of cable 13 does not necessarily have to equal the operating speed of motor 42, but there may be a corresponding relationship between the rotational speed of cable 13 and the operating speed of motor 42. For example, the relationship between the operating speed of motor 42 and the rotational speed of cable 13 may be determined by the pulley output produced by the combination of motor 42, motor drive pulley 45 and drive pulley 48. And, the pulley output may be determined by the gear/pulley ratio between drive pulley 48 and motor drive pulley 45. In one embodiment, the gear/pulley ratio between drive pulley 48 and motor drive pulley 45 may be 6:1, but any suitable gear/pulley ratio may be used.

Motor 42 may comprise an electric motor, such as a reversible, 1/7 UP, 90 volt DC motor capable of operating at speeds between about 600 RPM and about 1713 RPM or any other suitable motor. The operating speed of motor 42 may be varied by varying the amount of voltage supplied from motor control device 46 to motor 42. In one embodiment, motor 42 is configured to operate at an operating speed of about 1713 RPM when the motor is operating under no load and receiving about 90 volts of DC current. In such an embodiment, the pulley output produced by the combination of drive pulley 48 and motor drive pulley 45 (and, accordingly, the rotational speed of cable 13) may be about 286 RPM when motor 42 is operating under no load and receiving about 90 volts of DC current. Of course, motor 42, drive pulley 48, and motor drive pulley 45 may be configured to operate at any suitable operating speed and produce any suitable amount of pulley output.

Motor mounting bracket 44 is attached to the rear surface of frame mounting plate 32, as illustrated, and motor 42 is mounted to motor mounting bracket 44. Motor mounting bracket 44 may be attached to frame mounting plate 32 using any suitable method or device. Similarly, motor 42 may be mounted on motor mounting bracket 44 using one or more fasteners, such as screws and bolts, or any other suitable method or device. In the illustrated embodiment, drive pulley 48 engages drive shaft 41 extending through frame mounting plate 32. Drive pulley 48 is in mechanical communication with motor 42 via drive belt 49, which is looped around drive pulley 48 and motor drive pulley 45.

Figure 2:
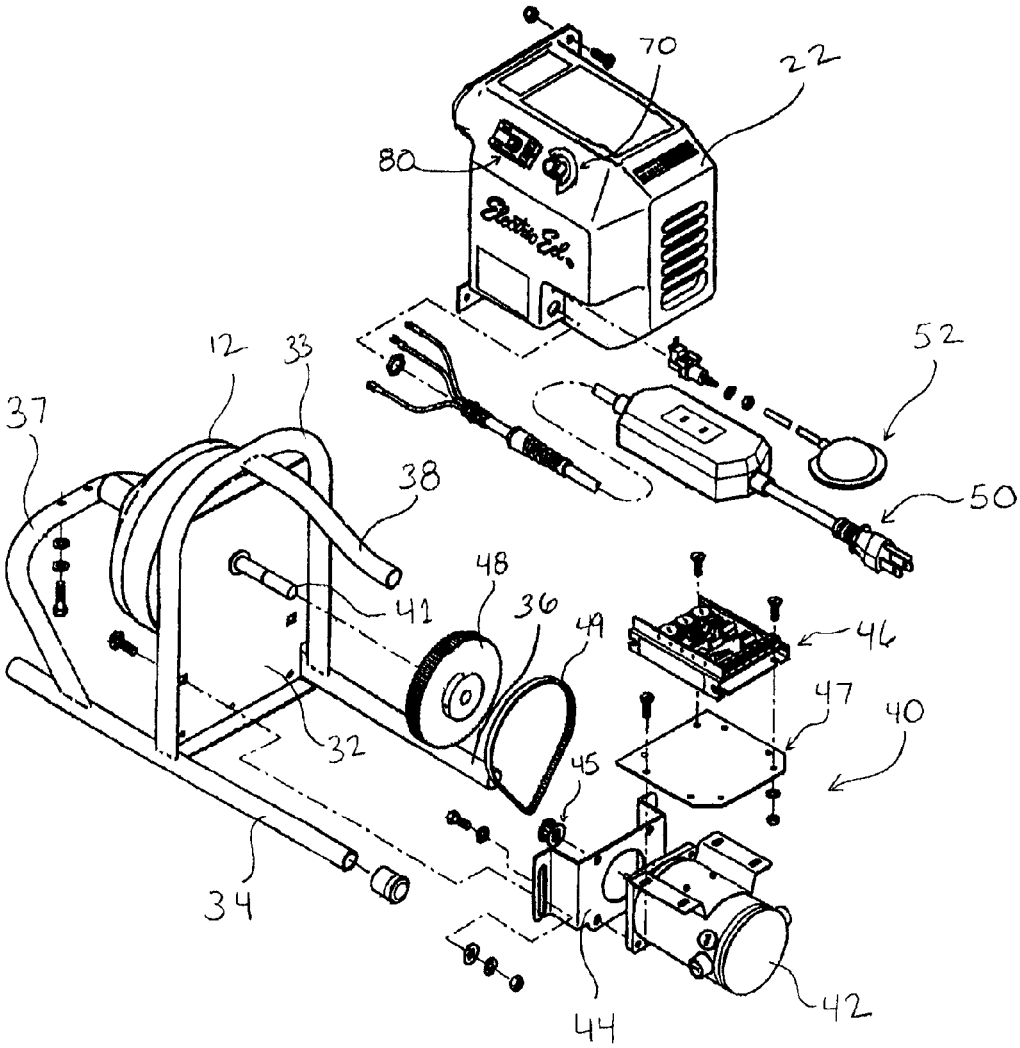
FIG. 2 depicts a perspective, exploded assembly view of the drain-cleaning machine illustrated in FIG. 1.
Figure 3:
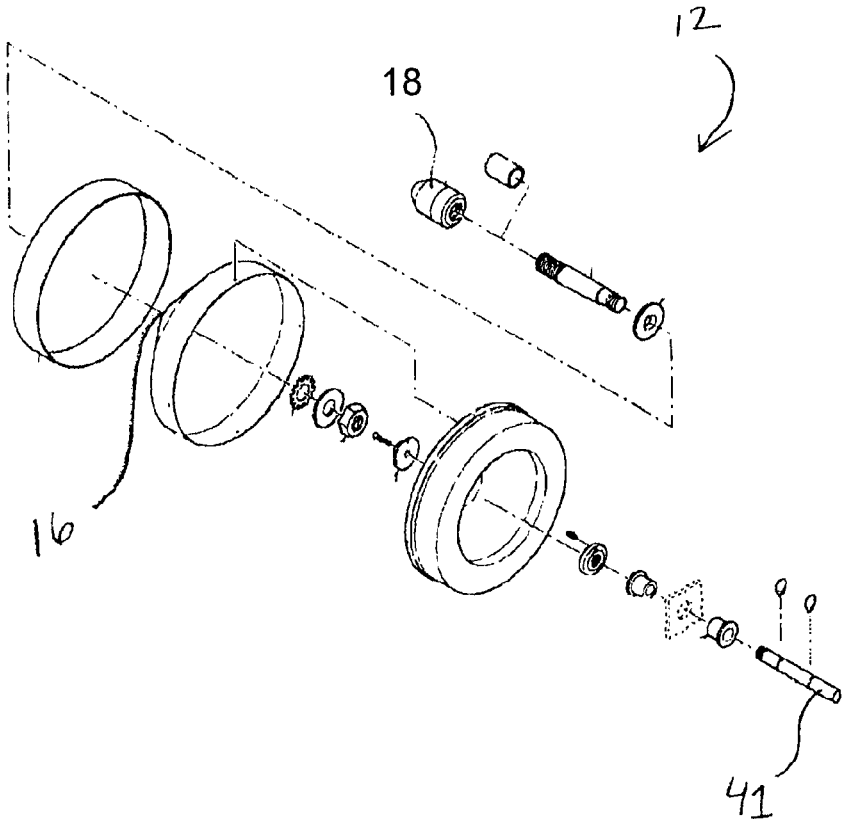
FIG. 3 depicts a perspective, exploded assembly view of an embodiment of a drum, such as the drum included the drain-cleaning machine illustrated in FIG. 1.
Figure 4:
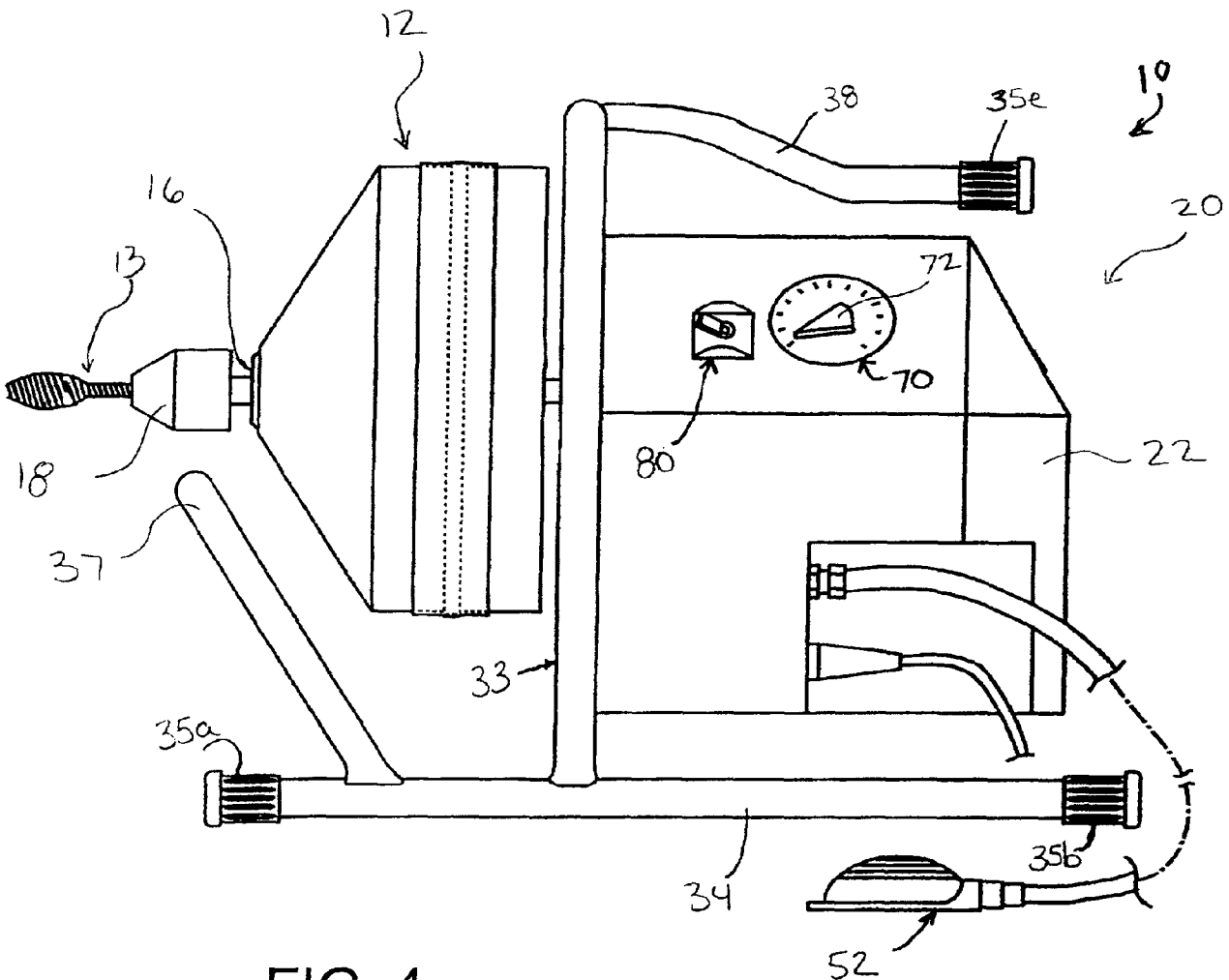
FIG. 4 presents a side view of the drain-cleaning machine illustrated in FIG. 1.
Figure 5:
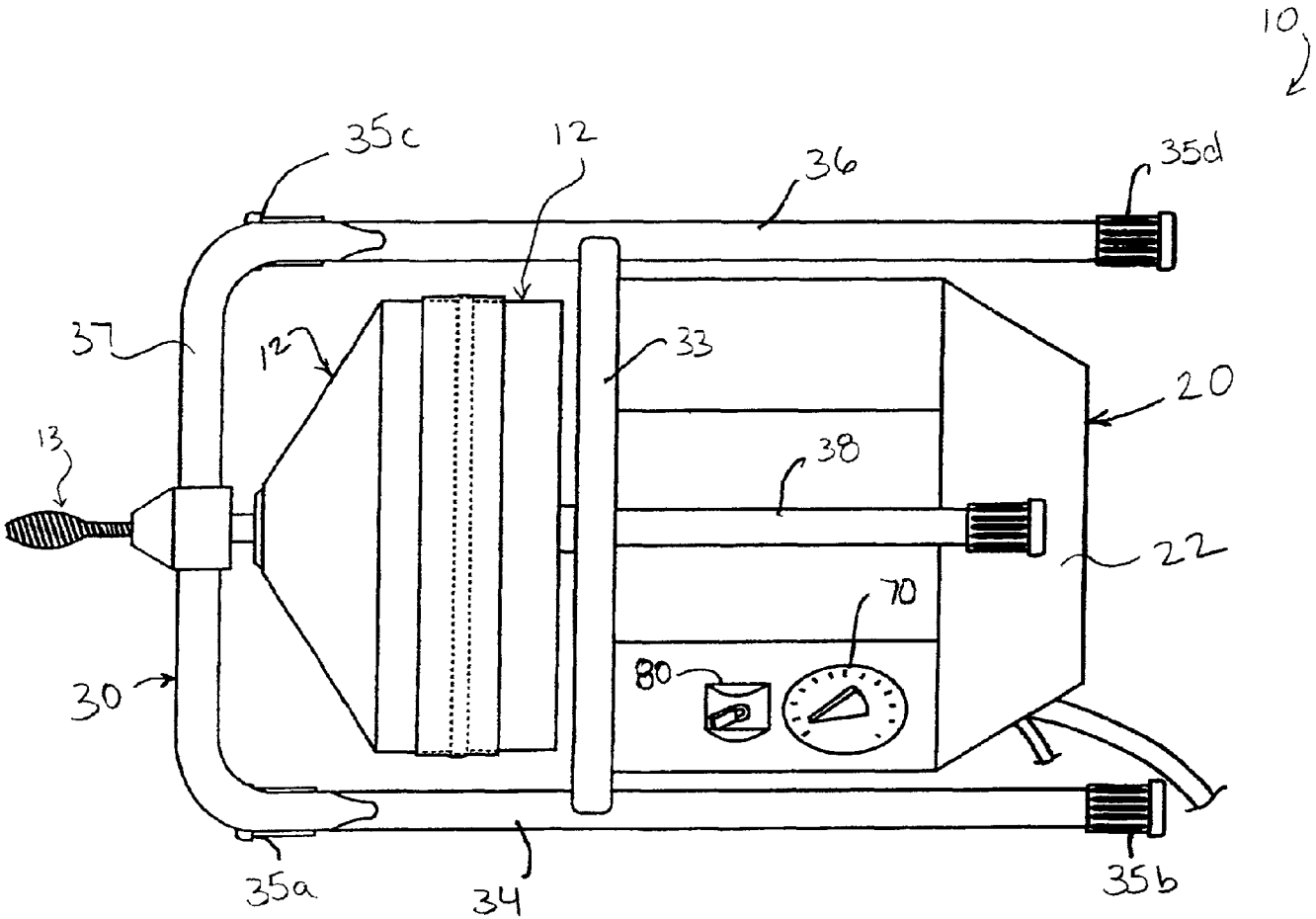
FIG. 5 depicts a top view of the drain cleaning machine illustrated in FIG. 1.

As shown in FIGS. 2 and 6, motor control device 46 is mounted atop motor 42 via motor control device mounting plate 47. Motor control device 46 may be mounted in any suitable location. Motor 42, motor control device mounting plate 47, and motor control device 46 may be attached to one another using one or more fasteners, such as screws and bolts, or any other suitable method or device. Motor control device 46 may be configured to receive AC power via power cord 50 and convert the AC power into DC voltage, which can then be communicated to and used to power motor 42. Motor control device 46 may further be configured to allow for the use of a variable potentiometer to vary the operating speed of motor 42. More specifically, speed control assembly 70, which may comprise a variable potentiometer or some other similar device, may be used to control and vary the amount of output voltage communicated from motor control device 46 to motor 42. The output voltage created by motor control device 46 may range from between about 30 volts and about 90 volts, although that specific range is not required. Motor control device 46 may be configured to create an output voltage within any suitable range.

Motor control device 46 may comprise a full wave bridge, or any other suitable device. In addition, motor control device 46 may comprise one or more adjustable settings configured to control one or more operating parameters. By way of example only, one of the adjustable settings may determine the current limit, which may help prevent overloading of the device by limiting the amount of current distributed to motor 42. Motor control device 46 may also comprise a minimum output voltage setting and maximum output voltage setting. The minimum output voltage setting and maximum output voltage setting may be adjustable and configured to establish the minimum and maximum amounts of output voltage communicated to the motor, thereby controlling the effective minimum operating speed and effective maximum operating speed of motor 42. As used herein, the term effective minimum operating speed refers to the speed at which the motor operates when receiving the minimum output voltage, and the term "effective maximum operating speed" refers to the speed at which the motor operates when receiving the maximum output voltage. By controlling the minimum output voltage setting and maximum output voltage setting, motor control device 46 may adjust the effective minimum operating speed and the effective maximum operating speed of motor 42. Motor control device 46 may also be configured to allow for voltage compensation. More specifically, motor control device 46 may be configured to automatically adjust voltage coming into motor control device such that the input voltage matches a target voltage. For instance, if the input voltage being communicated into motor control device 46 is 85 volts, that input voltage may be increased by motor control device to 120 volts, or some other appropriate target voltage. Similarly, if the input voltage is 135 volts, that input voltage may be decreased to 120 volts, or some other appropriate target voltage. Finally, motor control device 46 may be configured to produce variable horsepower from motor 42.

Figure 8:
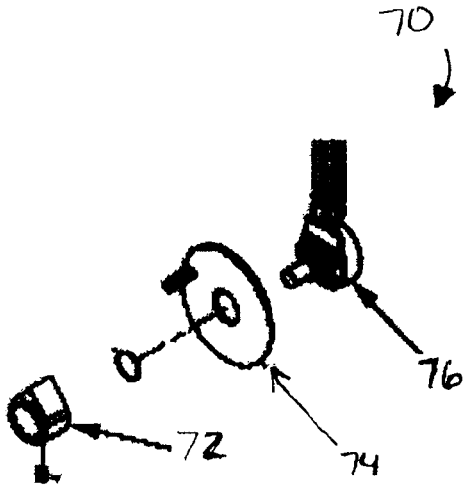
FIG. 8 depicts a perspective, exploded assembly view of an embodiment of a speed control assembly, such as the speed control assembly included in the drain-cleaning machine illustrated in FIG. 1.

Speed control assembly 70 may be configured to control the operating speed of motor 42, and, consequently, the rotational speed of cable 13. As shown in FIG. 8, speed control assembly 70 comprises a speed control knob 72, a speed control switch support 74 and a speed control switch 76. In the illustrated version, speed control knob 72 is rotatably attached to speed control switch 76, and the speed control switch support 74 is positioned between speed control knob 72 and speed control switch 76. Speed control knob 72 may be mounted on the exterior of housing 22 in order to allow a user to access and adjust speed control knob 72. Of course, other suitable types of controls, including but not limited to a slider or a digital control, may be used in place of speed control knob 72 to communicate with speed control switch 76. In the illustrated example, speed control switch 76 is in electrical communication with motor control device 46, such that the output voltage of motor control device 46 and, correspondingly, the operating speed of motor 42, may be adjusted in response to an adjustment of speed control knob 72. Speed control switch 76 may comprise a variable potentiometer, a foot control with a slide resistor, or any other suitable device.

Speed control assembly 70 may be configured to adjust the output voltage of motor control device 46 across a range of output voltages between a first/"low" setting and a second/"high" setting. Accordingly, speed control assembly 70 may also be configured adjust the speed of motor 42 across a range of speeds between a first/"low" setting and a second/"high" setting. The first/"low setting may correspond to the minimum output voltage setting of motor control device 46 and/or the rated minimum operating speed of motor 42, while the second/"high" setting may correspond to the maximum output voltage setting of motor control device 46 and/or the rated maximum operating speed of motor 42. In one such embodiment, speed control assembly 70 may be configured to control the speed of motor 42 across a range of speeds that encompasses speeds between and including a rated minimum operating speed and a rated maximum operating speed. As used herein, the term "rated minimum operating speed" refers to the minimum speed the motor was designed to operate at, and the term "rated maximum operating speed" refers to the maximum speed the motor was designed to operate at. The effective minimum operating speed may be greater than or substantially equal to the rated minimum operating speed. Similarly, the effective maximum operating speed may be less than or substantially equal to the rated maximum operating speed. Of course, motor 42 may be configured to operate within any suitable range of speeds.

Figure 9:
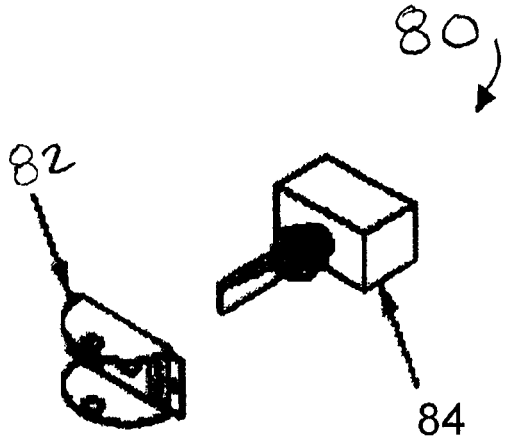
FIG. 9 depicts a perspective, exploded view of an embodiment of a directional switch assembly, such as the directional switch assembly included in the drain-cleaning machine illustrated in FIG. 1.

As shown in FIG. 9, directional switch assembly 80 comprises a directional switch 82 and a switch guard 84. Directional switch assembly 80 is in communication with motor 42 such that the direction of the rotational force provided by motor 42 can be controlled by directional switch 82. In one embodiment, directional switch 82 may be configured to transition motor 42 between a "forward" setting and a "reverse" setting. In an alternate embodiment, directional switch 82 may be configured to transition motor 42 between more than two settings. By way of example only, directional switch 82 may be configured to transition motor 42 between a "forward" setting, a "reverse" setting, and a third setting, including but not limited to an "off" setting and a "pause" setting. By way of example only, motor 42 may be configured to produce clockwise rotation in the "forward" setting and counter-clockwise rotation in the "reverse" setting. Of course, these orientations may be reversed, and any suitable terms may be used to refer to the settings.

In the embodiment shown in FIGS. 1-9, motor assembly 40 is configured to allow a user to vary the operating speed of motor 42, while simultaneously providing substantially constant torque across the entire range of operating speeds. As mentioned above, the output torque for a PSC/AC motor may fall off rapidly as the motor speed decreases under load, as illustrated in Graph A. As shown in Graph B, a permanent magnet motor is configured to produce constant torque despite receiving varying amounts of voltage (V1, V2, V3, V4, and V5) and operating at varying speeds.

This aspect of motor assembly 40 may increase safety and effectiveness for several reasons. First, the ability to adjust the operating speed of motor 42 may allow a user to operate the motor at a high speed while initially inserting cable 13 into a drain or sewer. Consequently, the user may be able to feed cable 13 into the drain or sewer at a much faster rate than if the motor 42 only operated at a single speed. Second, if cable 13 is rotating at a high speed when cable 13 engages an obstruction, cable 13 may become embedded in the obstruction. Consequently, a user can reduce the operating speed of motor 42 and rotational speed of cable 13 prior to engagement of the obstruction, thereby possibly preventing cable 13 from becoming embedded therein. Also, if motor 42 is capable of providing a substantially constant amount of torque, even at lower operating speeds, then cable 13 may be able to more effectively and thoroughly remove an obstruction. Third, after removing an obstruction, a user may increase operating speed of motor 42 in order to retrieve cable 13 more quickly. Finally, prior to cable 13 exiting the drain or sewer, the user may reduce the operating speed of motor 42 and rotational speed of cable 13 in order to help avoid whipping the cable, thereby helping to prevent cable 13 from damaging the area surrounding the drain or sewer (i.e. a tub or sink) and/or spraying matter in the surrounding area.

Figure 10:
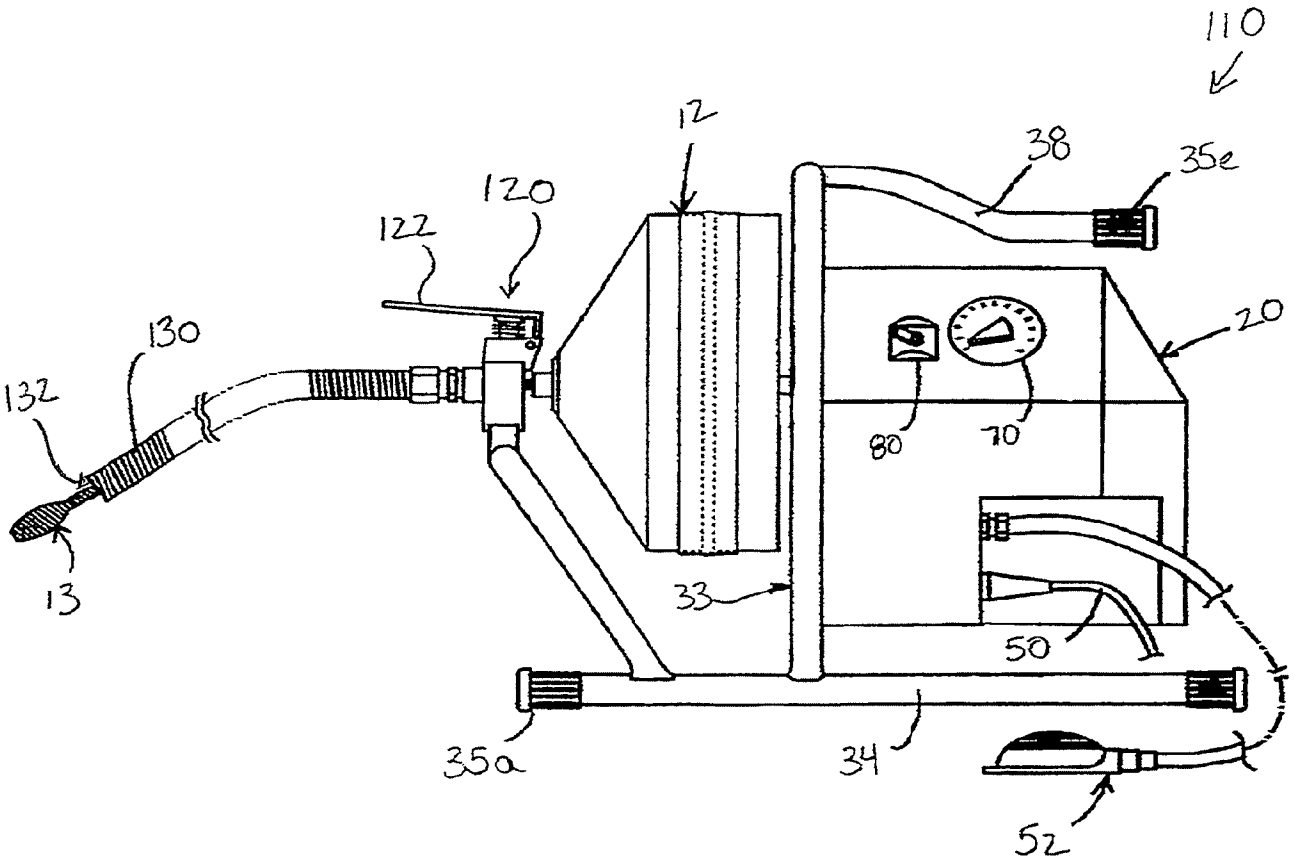
FIG. 10 depicts an alternate embodiment of a motorized drain-cleaning machine.
Figure 11:
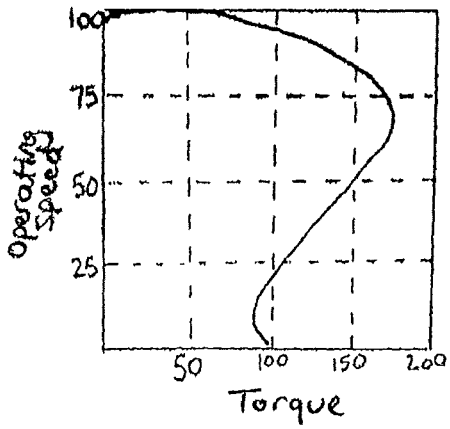
FIG. 11 depicts GRAPH A, which depicts the relationship between torque output and operating speed for a typical PSC/AC motor.
Figure 12:
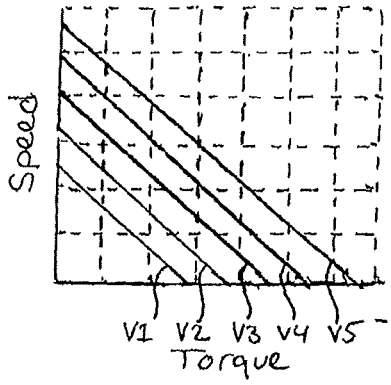
FIG. 12 depicts GRAPH B, which depicts a typical family of speed/torque curves for a permanent magnet (DC) motor at different voltage inputs, with the voltage increasing from left to right.

FIG. 10 depicts an alternate embodiment of a motorized drain-cleaning machine 110. This embodiment is substantially similar to the embodiment shown in FIGS. 1-8 and described above. However, as shown in FIG. 9, machine 110 comprises an auto feed mechanism 120 and a cable guide hose 130 in addition to the components shown in FIGS. 1-9 and described above. Of course, auto feed mechanism 120 and cable guide hose 130 are optional. Different embodiments may comprise both an auto feed mechanism 120 and a cable guide hose 130, only one of auto feed mechanism 120 and cable guide hose, or neither of auto feed mechanism 120 and cable guide hose 130. Auto feed mechanism 120 is configured to automatically feed cable 13 into and out of drum 12. The structure of auto feed mechanism 120 is well known within the art.

In the illustrated version, auto feed mechanism 120 comprises an actuator lever 122. Auto feed mechanism 120 may be configured to automatically feed cable 13 into and out of drum 12 through cable guide hose 130 when actuator lever 122 is depressed. For example, when the machine 110 is on and directional switch 82 is in a "forward" setting, a user can automatically feed cable 13 out of drum 12 and into a drain by depressing actuator lever 122. Alternatively, when the machine 110 is on and directional switch 82 is in a "reverse" setting, a user can automatically retrieve cable 13 and feed cable 13 back into drum 12 by depressing actuator lever 122. Of course, these orientations may be reversed. The speed at which cable 13 is fed into and out of drum 12 may be controlled by adjusting the operating speed of motor 42 via speed control assembly 70.

In the version shown in FIG. 10, cable guide hose 130 comprises a ribbed, elongated tube. In this example, cable guide hose 130 is attached to auto feed mechanism 120 and is configured to receive cable 13 as it passes out of drum 12 and through auto feed mechanism 120. As shown, cable guide hose 130 comprises an open distal end 132 configured to allow cable 13 to exit cable guide hose 130 and enter a drain. Cable guide hose 130 may be configured to reduce the potential for cable 13 to whip during insertion or retrieval, while also being configured to reduce the potential for cable 13 to spray water and other matter around the work area during retrieval from the drain. Of course, cable guide hose 130 may comprise any suitable length. Cable guide hose 130 may comprise plastic or any other suitable material. Cable guide hose 130 may further be flexible, extendable, or have any other suitable characteristics to facilitate use of machine 110.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A drain-cleaning machine comprising:

a) a cable, wherein the cable comprises a longitudinal axis; and b) a motor assembly, wherein the motor assembly is in mechanical communication with the cable, wherein the motor assembly is configured to rotate the cable about the longitudinal axis of the cable, wherein the motor assembly comprises i) a motor, wherein the motor is configured to operate at an operating speed, wherein the operating speed may vary within a range of operating speeds, wherein the motor is configured to produce substantially constant torque while operating at varying operating speeds across the entire range of operating speeds, wherein the motor is configured to be powered by DC power, and ii) a motor control device, wherein the motor control device is mounted to the motor, wherein the motor control device is configured to receive AC power from an AC power source, wherein the motor control device is configured to convert the AC power into DC power comprising an input voltage, wherein the motor control device communicates the DC power to the motor, wherein the DC power communicated from the motor control device to the motor comprises an output voltage, wherein the motor control device is further configured to subject the DC power to voltage compensation by adjusting the input voltage of the DC power to correspond to a target voltage prior to adjusting the input voltage of the DC power to the output voltage; and c) a speed control assembly, wherein the speed control assembly is in communication with the motor assembly, wherein the speed control assembly is configured to vary the operating speed of the motor within the range of operating speeds by controlling the output voltage of the DC power communicated from the motor control device to the motor.

2. The drain-cleaning machine of claim 1, wherein the output voltage may vary within a range of output voltages, wherein the operating speed of the motor corresponds to the output voltage received by the motor.

3. The drain-cleaning machine of claim 2, wherein the speed control assembly is configured to vary the output voltage within the range of output voltages.

4. The drain-cleaning machine of claim 1, wherein the motor assembly is configured to produce a rotational force in a first direction and a second direction, wherein the drain-cleaning machine further comprises a directional switch assembly, wherein the directional switch assembly is configured to allow a user to vary the direction of the rotational force produced by the motor assembly between the first direction and the second direction.

5. The drain-cleaning machine of claim 1, wherein the speed control assembly comprises a speed control knob and a speed control switch, wherein the speed control knob is rotatably attached to the speed control switch, wherein the speed control assembly is configured such that an adjustment of the speed control knob results in a corresponding adjustment in the operating speed of the motor.

6. The drain-cleaning machine of claim 5, wherein the speed control switch comprises a variable potentiometer.

7. The drain-cleaning machine of claim 1, wherein the motor comprises a reversible, 90 volt DC electric motor.

8. The drain-cleaning machine of claim 7, wherein the motor is configured to operate at speeds between about 600 RPM and about 1713 RPM.

9. The drain-cleaning machine of claim 1, wherein the target voltage is larger than the output voltage.

10. A drain-cleaning machine comprising a) a frame assembly;

b) a cable containing enclosure, wherein the cable containing enclosure is associated with the frame assembly for rotation about an axis of rotation, the cable containing enclosure comprising an opening in a front portion of the cable containing enclosure;

c) a cable, wherein at least a portion of the cable is coiled within the enclosure, wherein the cable comprises an operating end configured for insertion into a drain, wherein the operating end extends through the opening in the front portion of the enclosure;

d) an electric motor, wherein the electric motor is mounted to the frame assembly, wherein the electric motor comprises a permanent magnet motor comprising an output shaft, wherein the output shaft is in mechanical communication with the cable containing enclosure such that rotation of the output shaft results in corresponding rotation of the cable containing enclosure and the cable, wherein the electric motor is configured to operate within a range of operating speeds, wherein the range of operating speeds comprises a first operating speed and a second operating speed; and e) a motor control device, wherein the motor control device is mounted to the motor, wherein the motor control device is configured to receive AC power from an AC power source, wherein the motor control device is configured to convert the AC power into DC power, wherein the motor control device communicates the DC power to the electric motor, wherein the DC power comprises an input voltage, wherein the input voltage of the DC power is variable across a range of voltages, wherein the DC power communicated from the motor control device to the electric motor comprises an output voltage, wherein the motor control device is further configured to subject the DC power to voltage compensation by adjusting the input voltage of the DC power to correspond to a target voltage prior to adjusting the input voltage of the DC power to the output voltage; and (f) a speed control assembly, wherein the speed control assembly is in communication with the motor control device, wherein the speed control assembly is configured to control the output voltage of the DC power communicated by the motor control device to the electric motor.

11. The drain-cleaning machine of claim 10, wherein the electric motor comprises a DC motor.

12. The drain-cleaning machine of claim 10, wherein the motor control device comprises a first adjustable setting and a second adjustable setting, wherein the first adjustable setting is configured to establish a minimum output voltage, wherein the minimum output voltages comprises a minimum amount of voltage communicated by the motor control device to the motor, wherein the second adjustable setting is configured to establish a maximum output voltage, wherein the maximum output voltage comprises a maximum amount of voltage communicated by the motor control device to the motor.

13. The drain-cleaning machine of claim 12, wherein the motor is configured to operate within an inclusive range comprising an effective minimum operating speed and an effective maximum operating speed, wherein the first operating speed comprises the effective minimum operating speed, wherein the second operating speed comprises the effective maximum operating speed.

14. The drain-cleaning machine of claim 13, wherein the motor comprises a rated minimum operating speed and a rated maximum operating speed, wherein the effective minimum operating speed is greater than the rated minimum operating speed, and wherein the effective maximum operating speed is less than the rated maximum operating speed.

15. A drain-cleaning machine comprising:

a) a frame assembly, wherein the frame assembly comprises a plurality of elongated tubular members, wherein the plurality of elongated tubular members comprises i) a first lower support member, ii) a second lower support member, wherein the second lower support member comprises an elongated tubular member, wherein the first lower support member and the second lower support member are parallel to each other within a common horizontal plane, iii) an angled loop member extending between the first lower support member and the second lower support member, iv) a vertical loop member extending between the first lower support member and the second lower support member, v) a vertical mounting plate, wherein the vertical mounting plate is attached to the vertical loop member, wherein the vertical mounting plate comprises an opening, and vi) an upper support member comprising a fixed end and a free end, wherein the fixed end is attached to the vertical loop member, wherein the free end is oriented within a horizontal plane parallel to the horizontal plane containing the first lower support member and the second lower support member;

b) a drive shaft, wherein the drive shaft extends through the opening in the vertical mounting plate, c) a cable, wherein the cable comprises an operating end configured to be inserted into a drain, d) a drum, wherein the drum is rotatably mounted to the drive shaft, wherein the drum is configured to house at least a portion of the cable, wherein the cable and the drum are configured to rotate uniformly together with drive shaft, e) a motor, wherein the motor comprises a permanent magnet DC electric motor, wherein the motor comprises a motor output shaft, wherein the motor operates at a plurality of discrete operating speeds, wherein the motor is configured to produce an amount of torque while operating at each of the plurality of discrete operating speeds, wherein the motor is in mechanical communication with the drive shaft such that rotation of the motor output shaft produces corresponding rotation in the drive shaft;

f) a motor control device, wherein the motor control device is mounted to the motor, wherein the motor control device is configured to receive AC power from an AC power source, wherein the motor control device is configured to convert the AC power into DC power, wherein the motor control device is configured to provide the DC power to the motor, wherein the DC power comprises an input voltage, wherein the input voltage of the DC power is variable across a range of voltages, wherein the DC power provided by the motor control device to the motor comprises an output voltage, wherein the motor control device is further configured to subject the DC power to voltage compensation by adjusting the input voltage of the DC power to correspond to a target voltage prior to adjusting the input voltage of the DC power to the output voltage; and g) a speed control assembly, wherein the speed control assembly is configured to determine a current operating speed for the motor, wherein the current operating speed is selected from the plurality of discrete operating speeds.

16. The drain-cleaning machine of claim 15, wherein the drain-cleaning machine is configured to operate in a vertical orientation, wherein the drain-cleaning machine rests on the free end of the upper support member, a first end of the first lower support member, and a first end of the second lower support member while in the vertical orientation.

17. The drain-cleaning machine of claim 15 further comprising:

a) a motor drive pulley, wherein the motor drive pulley is rotatably mounted to the output shaft of the motor;

b) a drive pulley, wherein the drive pulley is rotatably mounted to the drive shaft;

c) a drive belt, wherein the drive belt is looped around the motor drive pulley and the drive pulley;

wherein rotational movement produced by the output shaft is communicated to the drive shaft via the motor drive pulley, the drive pulley and the drive belt.

18. The drain-cleaning machine of claim 17, wherein the gear/pulley ratio between the drive pulley and the motor drive pulley is 6:1.

19. The drain-cleaning machine of claim 17, wherein the drive pulley and the motor drive pulley are configured to create a maximum pulley output of about 286 RPM while the motor is operating at an effective maximum speed.

* * * * *

UNITED STATES PATENT AND TRADEMARK OFFICE

CERTIFICATE OF CORRECTION

PATENT NO. : 8,615,837 B2
APPLICATION NO. : 12/392604
DATED : December 31, 2013
INVENTOR(S) : C. David Hale and Alfred P. Horning It is certified that error appears in the above-identified patent and that said Letters Patent is hereby corrected as shown below:

In the Specification

Column 4, line 25 reads

"… 1/7 UP, 90 volt DC motor …"

and should be changed to read

"… 1/7 HP, 90 volt DC motor …"

Signed and Sealed this
Fourth Day of March, 2014

Michelle K. Lee

Michelle K. Lee
*Deputy Director of the United States Patent and Trademark Office*